United States Patent [19]

Fox

[11] 4,095,566

[45] Jun. 20, 1978

[54] VACUUM TIMING SYSTEM

[75] Inventor: Clarence D. Fox, Decatur, Ill.

[73] Assignee: Borg-Warner Corporation, Chicago, Ill.

[21] Appl. No.: 801,175

[22] Filed: May 27, 1977

[51] Int. Cl.[2] ..... H01H 35/34

[52] U.S. Cl. ..... 123/41.49; 123/198 D; 123/41.12; 200/83 R; 200/34

[58] Field of Search ..... 123/41.49, 41.12, 198 D, 123/198 DB, 198 DC, DIG. 11; 180/77 R, 82 R, 103 R; 200/83 R, 83 S, 83 T, 81 R, 81.4, 34

[56] References Cited

U.S. PATENT DOCUMENTS

| | | | |
|---|---|---|---|
| 1,993,070 | 3/1935 | Middleton | 290/37 |
| 2,562,286 | 7/1951 | Wall | 200/83 |
| 2,702,840 | 2/1955 | Jackson, Sr. | 200/83 |
| 3,125,702 | 3/1964 | Herridge, Jr. | 315/77 |
| 3,158,144 | 11/1964 | Walker | 123/DIG. 11 |

*Primary Examiner*—Gerald P. Tolin
*Attorney, Agent, or Firm*—Herman E. Smith

[57] ABSTRACT

A vacuum controlled timing system for an electrical accessory circuit of an internal combustion system having a variable vacuum source provides a uniform residual vacuum condition for maintaining a closed circuit for a selected time interval after the engine is rendered inoperative.

3 Claims, 1 Drawing Figure

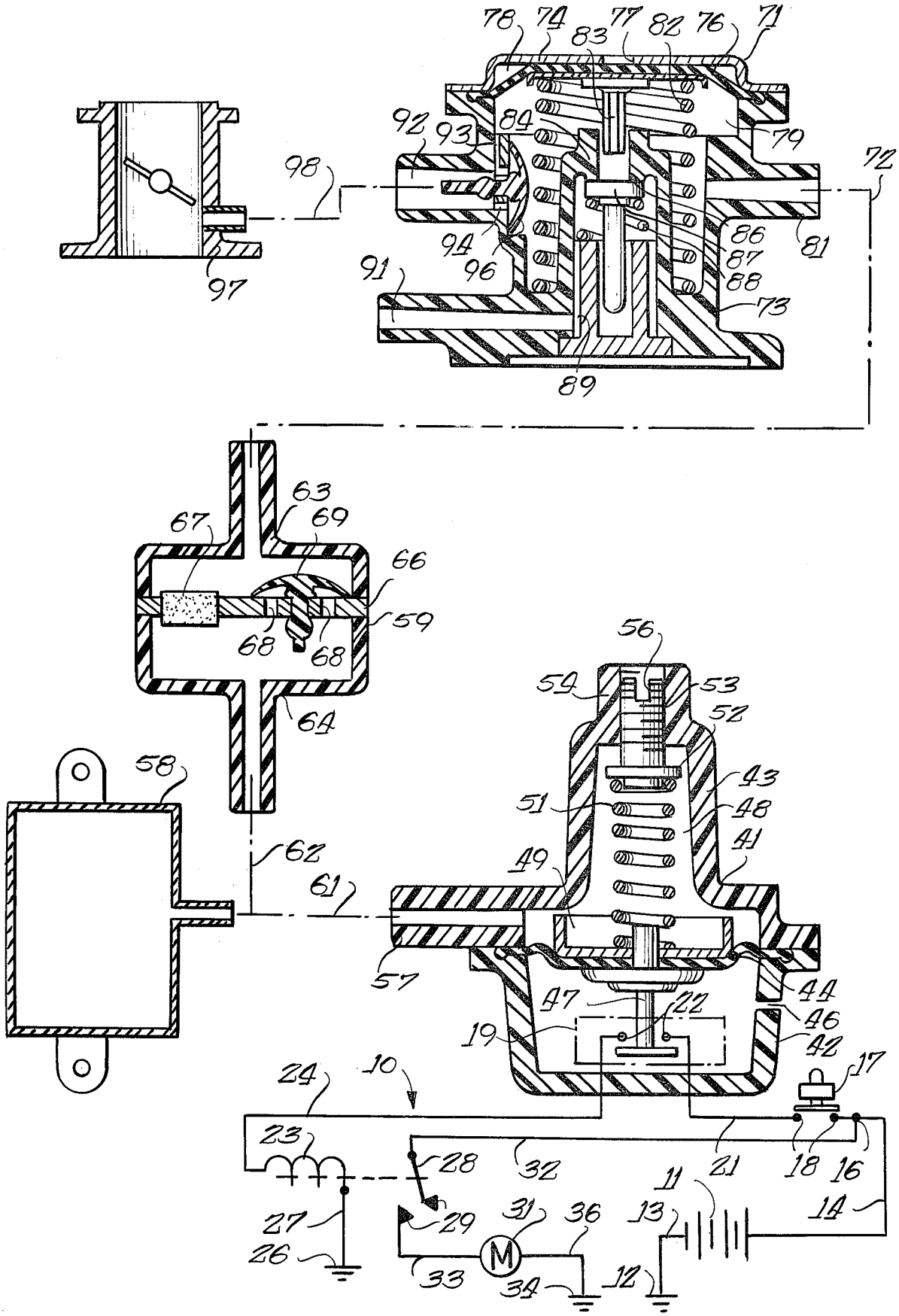
78
74
83
77
82
76
71
92
93
84
79
98
72
94
96
86
87
88
81
91
73
97
89
63
69
67
66
59
68
68
64
56
54
53
52
58
43
51
48
41
62
49
61
57
44
47
22
46
19
42
17
24
10
23
28
32
21
18
16
11
27
29
31
36
13
14
26
33
34
12

VACUUM TIMING SYSTEM

BACKGROUND OF THE INVENTION

1. Field.

The present invention relates to a system in which a residual vacuum condition is employed for maintaining an electrical accessory circuit of an internal combustion engine in an energized condition for a selected time interval after the engine is rendered inoperative.

2. Prior Art.

In the prior art it is known to employ a residual vacuum for the purpose of maintaining an electrical switch in a selected condition. Such systems often employ an evacuated chamber connected to a flow restrictor for bleeding the evacuated chamber to atmosphere. In such cases, the time interval is determined by the restriction of the flow restrictor, the volume of the evacuated chamber, and the level of subatmospheric depression in the chamber. Where the intake manifold of an internal combustion engine is employed for evacuating the chamber, the subatmospheric depression in the chamber is apt to vary, for example, depending upon whether the engine was revved up or allowed to idle immediately before the ignition switch was turned off. Such variations in the level of subatmospheric depression may result in variations in the time interval. Improvements in vacuum operated timing systems are desirable in order to provide a repeatably uniform time delay for accessory circuits of internal combustion engines.

SUMMARY OF THE INVENTION

The present invention relates to a vacuum operated timing system for an accessory circuit of an internal combustion engine capable of providing a repeatable uniform time interval for operation of an electrical accessory after the engine has been rendered inoperative. The improved system according to the present invention provides a residual vacuum condition characterized by a uniform subatmospheric depression even though the depression of the vacuum source may vary. More particularly, the system according to the present invention employs a vacuum switch means which is maintained closed below a first selected level of subatmospheric depression, and a vacuum regulator which limits evacuation of the switch means to a second level of subatmospheric depression lower than said first level of depression, in combination with flow restricting means arranged for controlling the bleeding of atmospheric air to said switch means after the engine is rendered inoperative. While the invention is useful for operating various accessory circuits, it is particularly advantageous for operating an electrically driven cooling fan of an internal combustion engine for a selected time interval after the engine has been turned off. A uniform time interval for operation of such a cooling fan can provide sufficient cooling protection for the engine while avoiding unnecessary drain on the vehicle battery.

BRIEF DESCRIPTION OF THE DRAWING

The drawing is a dragramatic view of the system according to the present invention, in which electrical components are shown schematically and in which pneumatic components are shown in section.

DESCRIPTION OF THE PREFERRED EMBODIMENT

Referring now in more detail to the drawing, an electrical accessory circuit 10 for use with an internal combustion engine is shown schematically in which a battery 11 is grounded as at 12 by conductor 13. The positive side of battery 11 is connected to a conductor 14 leading to terminal 16. A thermally actuated switch 17 is connected to terminal 16 and is arranged to close the contacts 18, 18 above a selected temperature and to open the contacts 18, 18 below the selected temperature. Thermally actuated switch 17 is connected to a vacuum operated switch 19 by conductor 21. The switch 19 is shown schematically as including contacts 22 and in practice may be of a type in which the contacts are encapsulated and operated by means of an external button. The contacts are arranged to be in closed circuit condition in response to a subatmospheric level of depression below a selected level and to be in open circuit condition above the selected level of subatmospheric depression. Switch 19 is connected to a relay coil 23 by a conductor 24, and the coil is in turn connected to ground at 26 by a conductor 27. An armature 28 is associated with relay coil 23 such that the contacts 29, 29 are in open circuit when the coil is deenergized, and in closed circuit when the coil is energized. The contacts 29, 29 are connected between terminal 16 and fan motor 31 by conductors 32 and 33. Fan motor 31 is connected to ground 34 by conductor 36.

When both of switches 17 and 19 are in closed circuit condition, current is permitted to flow through relay coil 23 which closes contacts 29, 29 resulting in operation of fan motor 31. When either of switches 17, or 19 is in open circuit condition, the flow of current in relay coil 23 is interrupted which opens contacts 29, 29 and thereby interrupts the operation of fan motor 31. Thus, the accessory circuit responds to the combination of temperature and a controlling vacuum condition.

It has been found that movement of a vehicle often provides sufficient cooling for the engine such that additional cooling by a fan is neither necessary nor desirable, in which case the thermally actuated switch 17 disables the fan motor 31. On the other hand, it has been found desirable to continue operation of a cooling fan following a period of high temperature operation even though the engine has been turned off. If the fan is allowed to operate for too long after the engine is turned off, the battery 11 becomes depleted of its electrical charge such that the engine cannot be restarted.

A regulated residual vacuum is provided for controlling the operation of switch 19 such that the time interval during which fan motor 31 can be operated after the engine has been turned off is limited to a predetermined maximum, such as, for example, ten minutes.

A vacuum motor 41 is employed for operation of switch 19. Vacuum motor 41 includes a lower housing portion 42 and an upper housing portion 43 separated by a flexible diaphragm 44. The lower side of diaphragm 44 is exposed to ambient atmospheric pressure by means of a vent 46 in lower housing portion 42. A stem 47 is secured to diaphragm 44, and is movable relative to contacts 22, 22. The upper housing portion 43 defines in part a vacuum chamber 48 to which the upper side of diaphragm is exposed. A cup shaped member 49 engages the upper side of diaphragm 44 and provides a seat for a rate spring 51. The upper end of rate spring 51 bears against an adjustable abutment 52.

The adjustable abutment 52 includes a threaded portion 53 received in a collar portion 54 of upper housing 43. A screw driver slot 56 is provided for adjusting abutment 52 with respect to collar portion 54 and to thereby adjust the preload on diaphragm 44. A vacuum port 57 communicates with vacuum chamber 48.

When a minus pressure, or subatmospheric depression, exists in vacuum chamber 48, the diaphragm 44 is urged upwardly against the bias of rate spring 51. At a selected level of subatmospheric depression, as determined by the adjustment of abutment 52, the diaphragm will overcome the resistance of rate spring 51 allowing the stem 47 to rise so that the contacts 22, 22 are in closed circuit condition.

In some cases it is desirable to supplement the volume of vacuum chamber 48 by adding an auxiliary vacuum chamber 58. The auxiliary vacuum chamber 58 is connected to vacuum motor 41 and delay valve 59 by means of tubing indicated in the drawing by broken lines 61, 62.

Delay valve 59 includes an inlet portion 63, and an outlet portion 64 separated by a barrier 66. Outlet portion 64 is connected to vacuum motor 41 and auxiliary vacuum chamber 58 by tubing indicated by broken lines 62. 61. Barrier 66 includes a porous plug 67 which functions as a flow restrictor. The plug 67 provides a multiplicity of very small passages through which air can flow from one side of barrier 66 to the other. The resistance of the plug imposes a time delay on flow of air through the plug. The barrier 66 also includes apertures 68, 68 which imposes very little restriction to the flow of air. An umbrella type check valve 69 is mounted in barrier 66 and covers the apertures 68, 68. The delay valve 59 permits rapid flow of air from outlet 64 to inlet 63 through the orifices 68, 68 and check valve 69, but imposes a time delay on air flow from inlet 63 to outlet 64 through restrictor plug 67. The inlet portion 63 of delay valve 59 is connected to vacuum regulator 71 by means of tubing indicated by broken line 72.

Vacuum regulator 71 includes a housing 73, a cover 74, and a diaphragm 76. The cover 74 includes an aperture 77, and defines an atmospheric chamber 78 above diaphragm 76. Housing 73 includes an internal cavity defining a regulator chamber 79 below the diaphragm 76. A tube connector 81 provides communication from regulator chamber 79 to tubing 72. A regulator rate spring 82 is disposed in regulator chamber 79 and bears upwardly on diaphragm 76. A post 83 depends from diaphragm 76 and is received within a collar portion 84 of housing 73. The lower portion of collar 84 forms a valve seat 86 which is normally closed by valve member 87. An antigravity spring 88 supports valve member 87 in contact with valve seat 86. The valve member 87 is exposed to ambient atmospheric pressure through air passages 89 and 91.

Regulator chamber 79 communicates with an inlet passage 92 through a first orifice 93 which is always open and through auxiliary orifices 94, 94 which are covered by an umbrella check valve 96. Inlet passage 92 is connected to the inlet manifold portion 97 of an internal combustion engine by means of tubing indicated by broken line 98.

The various components of the system described above cooperate with each other to provide a uniform residual vacuum condition for operation of switch 19 for a time interval after the engine has been rendered inoperative. The operation of these components is described more fully below.

When an internal combustion engine is operated, a subatmospheric depression is created below the throttle in the inlet manifold, the level of depression being variable depending on the speed of operation of the engine. The subatmospheric depression of the engine manifold is communicated to regulator chamber 79 through tubing 98, inlet passage 92, and orifice 93. The depression in regulator chamber 79 lowers diaphragm 76 against the bias of regulator rate spring 82 until post 83 engages valve member 87. Thereafter the depression in the regulator chamber 79 remains constant due to bleeding of atmospheric air through passages 89, 91 around valve member 81 through valve seat 86. The evacuation of the system proceeds at the constant level of subatmospheric depression, or minus pressure, from regulator chamber 79 through tube 72, check valve 69, orifices 68, 68, tube 62 to the auxiliary vacuum chamber 58 and through tube 61 to vacuum motor 41. The relatively unrestricted flow through orifices 68, 68 permits rapid evacuation of the vacuum motor 41 to the level of depression existing in regulator chamber 79. The level of subatmospheric depression in the system as determined by the regulator chamber is selected to be lower than the level required for maintaining the switch 19 in closed circuit condition.

When the engine is rendered inoperative, ambient atmospheric air passes around the throttle to the intake manifold and from the manifold through tube 98 to inlet passage 92. The pressure of air at ambient atmospheric pressure in inlet passage 92 opens umbrella check valve 96 resulting in a rapid pressure change in regulator chamber 79 due to the flow of air at atmospheric pressure through orifice 93 and auxiliary orifices 94, 94. The atmospheric pressure in regulator chamber 79 is communicated to inlet portion 63 of delay valve 59 by means of tubing 72. The atmospheric pressure in inlet portion 63 holds umbrella check valve 69 closed such that flow through the delay valve occurs through the restrictor plug 67. Thus as soon as the engine is turned off, that portion of the system between the manifold and barrier 66 returns immediately to atmospheric pressure, while a residual vacuum condition is trapped in the portion of the system between barrier 66 and vacuum motor 41. The pressure differential across barrier 66 causes air to flow through restrictor plug 67 from inlet portion 63 to outlet portion 64 of delay valve 59. As air flows through restrictor plug 67, the subatmospheric depression in vacuum motor 41 gradually changes toward atmospheric pressure. After an interval of time, the level of depression in the vacuum motor will have changed sufficiently to permit rate spring 51 to move diaphragm 44 and stem 47 to a position placing contacts 22, 22 in open circuit condition. The time interval during which switch 19 remains closed after the engine has been stopped is determined by the flow rate of restrictor 67, the volume of vacuum chambers 48 and 58 and the pressure differential between maximum depression and the level of depression which permits switch 19 to move to open circuit condition. The level of depression which permits switch 19 to move to open circuit condition is controlled by means of adjustment of abutment 52. Inasmuch as the maximum depression in the system is limited by regulator 71 and the volume of the vacuum chambers remain substantially constant, and the flow rate of the restrictor remains substantially constant, the time interval can be selected by adjustment of abutment 52. Once the time delay has been selected, subsequent operation yields a repeatable uniform time delay inasmuch as the regulator limits the maximum depression in the system and the other factors affecting time interval remain substantially constant.

What is claimed is:

1. A vacuum operated timing system for use with an electrical accessory circuit of an internal combustion engine having a variable vacuum source, said system including:

an electrical switch connected in said accessory circuit;

vacuum motor means connected to said switch rendering said switch closed below a first selected level of subatmospheric depression in said motor means;

a flow restrictor communicating with said vacuum motor means;

wherein the improvement comprises a vacuum regulator communicable with ambient atmosphere, with said variable vacuum source and with said vacuum motor means, said regulator including means limiting evacuation of said motor means to a second selected level of subatmospheric depression lower than said first selected level of depression while said engine is operative regardless of variation in the level of said vacuum source, said vacuum regulator further including means arranged for permitting air bleeding of said vacuum motor means through said flow restrictor when said engine is rendered inoperative;

whereby said switch is retained in closed condition for a selected time interval after said engine is rendered inoperative.

2. A vacuum operated timing system according to claim 1 including check valve means connected in flow parallel with said flow restrictor, said check valve means opening in response to evacuation of said vacuum motor means and closing in response to air bleeding of said vacuum motor means.

3. A vacuum operated timing system according to claim 1 wherein said vacuum motor means includes a first rate spring for selecting said first selected level of subatmospheric depression, and said regulator includes a second rate spring for selecting said second selected level of subatmospheric depression.

* * * * *